US008434195B2

(12) United States Patent
Kronabeter et al.

(10) Patent No.: US 8,434,195 B2
(45) Date of Patent: May 7, 2013

(54) DOOR RAIL AND DOOR ATTACHMENT SYSTEM FOR PASSENGER RAIL CARS

(75) Inventors: Martin Kronabeter, Freundorf (AT); Markus Pollreiss, Frauenkirchen (AT)

(73) Assignee: Siemens AG Österreich, Vienna (AT)

( * ) Notice: Subject to any disclaimer, the term of this patent is extended or adjusted under 35 U.S.C. 154(b) by 649 days.

(21) Appl. No.: 12/594,646

(22) PCT Filed: Oct. 29, 2007

(86) PCT No.: PCT/EP2007/061580

§ 371 (c)(1),
(2), (4) Date: Oct. 5, 2009

(87) PCT Pub. No.: WO2008/122318

PCT Pub. Date: Oct. 16, 2008

(65) Prior Publication Data

US 2010/0037434 A1 Feb. 18, 2010

(30) Foreign Application Priority Data

Apr. 5, 2007 (AT) ..... A 540/2007

(51) Int. Cl.
*B61D 19/00* (2006.01)

(52) U.S. Cl.
USPC ..... 16/96 R; 16/94 R; 105/378; 296/146.9

(58) Field of Classification Search ..... 16/96 R, 16/87.4 R, 90, 94 R, 95 R; 105/378; 296/146.9, 296/155, 138; 49/426
See application file for complete search history.

(56) References Cited

U.S. PATENT DOCUMENTS

| | | | | |
|---|---|---|---|---|
| 1,548,125 | A * | 8/1925 | Elliott | 49/426 |
| 1,768,060 | A * | 6/1930 | Heinen et al. | 105/378 |
| 1,798,180 | A * | 3/1931 | Tobin et al. | 16/94 R |
| 6,834,909 | B1 * | 12/2004 | Malfent et al. | 296/138 |

FOREIGN PATENT DOCUMENTS

| | | | |
|---|---|---|---|
| DE | 8226126 | U1 | 11/1982 |
| GB | 2071582 | A | 9/1981 |
| WO | WO 0218735 | A1 | 3/2002 |
| WO | 2008122318 | A1 | 10/2008 |

* cited by examiner

*Primary Examiner* — William L. Miller

(57) ABSTRACT

A covering as a part of a guide carrier on a door rail for a sliding door system of a rail car is provided. The guide carrier runs along a horizontal edge of a door opening of a car body of the rail car and has a guide device for a sliding support of a sliding door. The covering serves to cover at least the door rail and support elements on the outside.

6 Claims, 4 Drawing Sheets

DOOR RAIL AND DOOR ATTACHMENT SYSTEM FOR PASSENGER RAIL CARS

CROSS REFERENCE TO RELATED APPLICATIONS

This application is the U.S. National Stage of International Application No. PCT/EP2007/061580 filed Oct. 29, 2007, and claims the benefit thereof. The International Application claims the benefits of Austrian Application No. A540/2007 AT filed Apr. 5, 2007, both of the applications are incorporated by reference herein in their entirety.

FIELD OF INVENTION

The invention relates to a door attachment system of a rail car, especially a passenger rail car, as well as to a door rail for a sliding door system of such a rail car with a rail carrier running along a horizontal edge of a door opening of the car body and able to be attached to the car body, in which a guide device for the sliding support of retaining elements of a sliding door is provided, with a cover being provided for covering at least the door rail and the retaining elements on the outside.

BACKGROUND OF INVENTION

Door attachment systems of this type are well known, for example in connection with subway rail cars. The covering of the door attachment serves to protect the mechanics of the door rail, including protection thereof from dust, rain and water spray, as well as visible protection, but also conversely to protect passengers from being injured by the door rail mechanics.

A typical example of a known realization of a door attachment with a cover on the lintel and the threshold of a subway rail car is shown in FIGS. 4 and 5 respectively. As can be seen from FIG. 4, which shows a view of the rail car above the door opening (lintel) in cross section, the cover 111 of the upper door rail with rail carrier 112 is a component of the rail car body 113. The cover 111 forms a projection on the car body which is drawn upwards and downwards on its outer side. The part 114 drawn upwards forms a gutter which extends over the length of the door, mostly along the entire car and because of its function as a cover 111, has also earned the name "rain gutter cover". The part of the rain gutter cover 111 drawn downwards should cover the door leaf 117 for sealing and acoustic reasons. The cover 111 is additionally equipped with a plate 116 which ensures that the cover has the appearance to an observer of being closed.

The cover 121 shown in FIG. 5 for the lower door rail on the other hand is a separate component which is mounted on the lower car body area 123 with the aid of a bracket 124 or a similar means of attachment. The cover 121 is thus attached below the door threshold and the associated guide carrier 122 and projects beyond the guide rail from there.

SUMMARY OF INVENTION

In the known construction, the cover is thus a part of the car body assembly. This makes the construction of the cover expensive and complicates the (independent) installation of the door rail and sliding door, since the door rail belongs to the same assembly as the door, which is generally purchased from a different supplier.

An object of the invention is thus to find a way which overcomes the stated disadvantages and simplifies the construction and installation of door rail and cover.

The stated object is achieved by a door rail in which, in accordance with the invention, the rail cover is part of the guide rail carrier.

The solution requires a design of the rail cover spanning multiple assemblies or a new assignment of the cover to the assembly of the door rail, but brings various benefits, such as simplified installation and maintenance and shorter installation times. The reduction in the number of components, in addition to simplifying installation, also reduces the cost, and last but not least improves the stability of the cover. The integration of the cover into the rail carrier makes it unnecessary to consider a separate interface on the car body for the cover.

In a preferred embodiment of the invention the guide facility has a guide rail for retaining elements of the sliding door designed to slide within it, with the cover preferably being embodied in one piece with the guide rail.

Preferably the cover is embodied in one piece with a component of the guide carrier able to be rigidly connected to the car body, in order to improve the stability of the construction and avoid sealing joints.

In respect of adjustment means provided on the guide device side to adjust the position of the sliding door, it is advantageous for the adjustment means to face towards the inner side of the sliding doors and to be able to be operated from inside. This facilitates access to these elements during installation and maintenance.

The cover can advantageously feature an attachment means by means of which the cover is also able to be attached to the rail car body.

The protective effect of the guide rail cover is further enhanced (mechanical protection, protection from injury, protection against water spray and rainwater etc.) if it also projects beyond an edge strip of the sliding door.

An especially significant application of the invention relates to external sliding doors; in this case the guide carrier expediently faces outwards. In a door attachment system of a rail car, especially a passenger rail car, preferably one inventive door rail is realized for a lintel and one for a threshold of a door opening, in which the guide device is provided to give sliding support for retaining elements on the upper or lower edge of the sliding door.

BRIEF DESCRIPTION OF THE DRAWINGS

The invention along with further advantages is explained below with reference to a non-restrictive exemplary embodiment which is shown in the accompanying drawings and relates to the door attachment for a subway rail car. The drawings show.

DETAILED DESCRIPTION OF INVENTION

Figure 1:
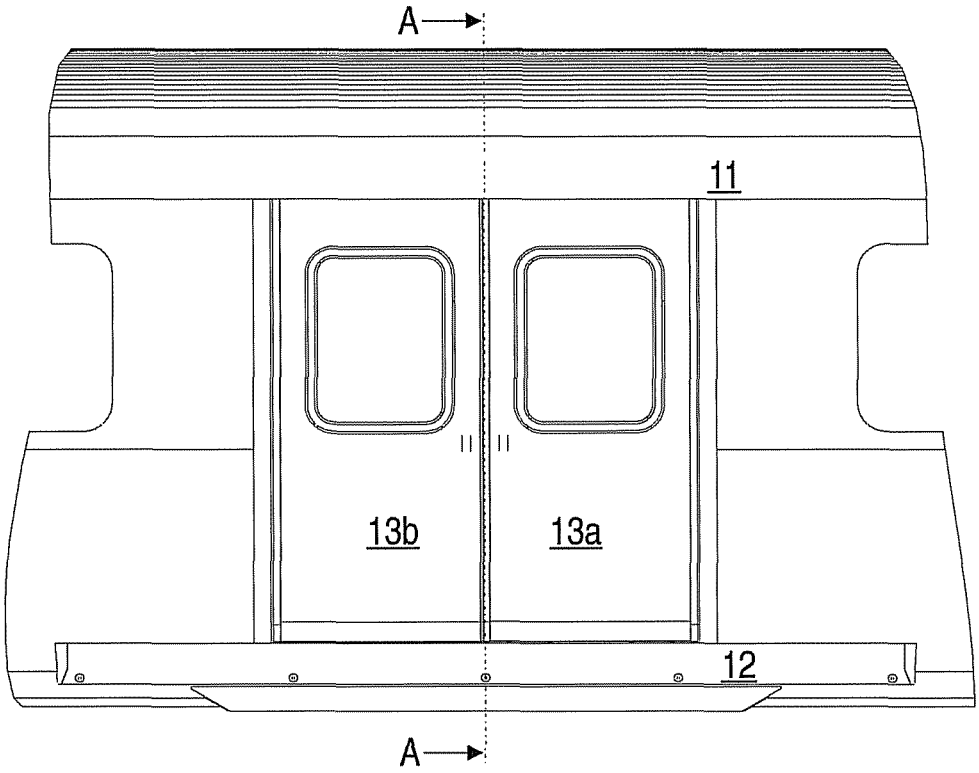
FIG. 1 a door area of a subway rail car, in which the invention can be realized, in a view of the car from the side.

A double sliding door system, for which the invention is realized, is realized in FIG. 1. The upper cover 11 and the lower cover 12 respectively hide the view of (hidden) door mechanics which hold the door leaves 13*a*, 13*b* of the sliding door and steer and guide the sliding movement. In the embodiment shown the upper cover 11 extends over the entire length of the car (typically appr. 20 m), partly for aesthetic reasons, partly for improved mechanical rigidity as well as if necessary to perform the function as a "rain gutter" for taking away water, whereas the lower cover 12 is only realized in the door area and is interrupted between the door areas. The length of the lower cover 12 is selected so that it covers the lower door rail, so that even in their fully-opened state, the door leaves do not project beyond the cover.

Figure 2:
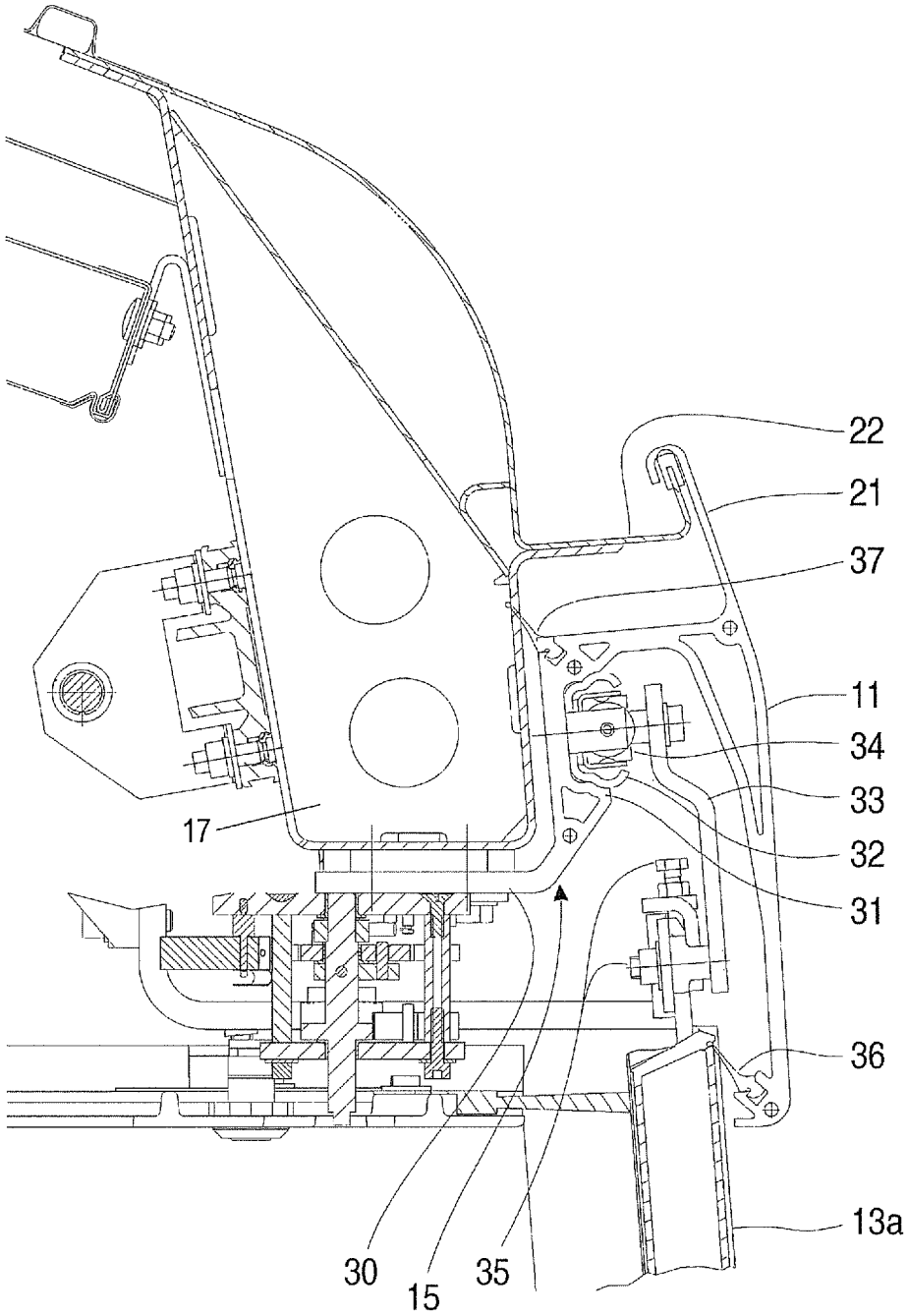
FIGS. 2 and 3 an inventive door attachment a cross-sectional view of the cut plane A-A depicted in FIG. 1 transverse to the longitudinal direction of the car, with FIG. 2 showing the upper door rail and FIG. 3 the lower door rail.

FIG. 2 shows the upper door guide with inventive integrated upper cover 11 in a detail of a cross-sectional view of plane A-A of FIG. 1 (around the middle of the double door) in accordance with a section showing the environment of the upper door edge on the right hand side of the rail car. The door rail serves to retain the doors and guide the door movement. The upper door rail 15 is divided into a guide rail carrier 30, an attachment strip 31, with the aid of which the upper door rail is attached to the car body, as well as the cover 11, which inventively is connected as part of the guide carrier to the guide rail carrier 30 and the attachment strip 31 and preferably forms one piece with these components.

Figure 5:
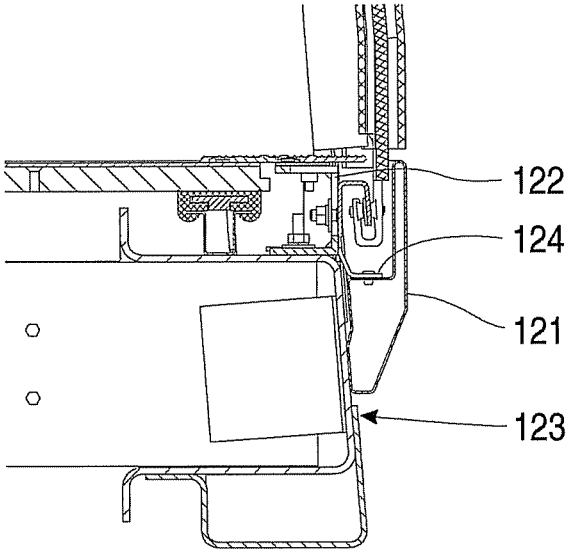
Fig. 5 Prior art

Mounted on the guide rail carrier 30 is a guide rail 32. The guide rail 32 serves to guide the door leaves 13*a*, 13*b* via retaining elements in the form of door leaf carriers 33, which are connected via runners 34 to the door leaf so that the door leaves are attached to allow them to move. In a manner known per se the door leaf carriers 33 feature adjustment screws 35, which the aid of which the position of the doors can be adjusted. However the adjustment screws 35, since the cover is integrated with the guide rail in accordance with the invention, are now displaced to the top edge of the doors and face towards the inside of the car in order to provide the user with access from the inside. By contrast with known constructions (cf. FIG. 5), where the adjustment elements 118 are in the direct vicinity of the guide rail and—after removal of the cover 111—are able to be operated from outside. In a variant of the embodiment shown the adjustment means to adjust the position of the door can be realized from the guide carrier side.

The cover 11 covers the guide rail 32, the door leaf carriers 33 including the runner 34 and the upper edge of the door leaf. On the upper edge the cover preferably features a projection 21 which is directed upwards like a leaf and is supported, e.g. suspended in a corresponding projection 22 of the rail car body. The projection 22 can realize a "rain gutter" for example. Seals 36, 37 provided in the cover (against the door leaf 13*a* or the car body 17) ensure that the mechanics and the passenger compartment are protected against contamination from outside. Another result from the cover extending over the overall length of the car—especially when it is in one piece with the guide carrier—is an increased mechanical stability and an improved aesthetic overall impression of the car.

Figure 3:
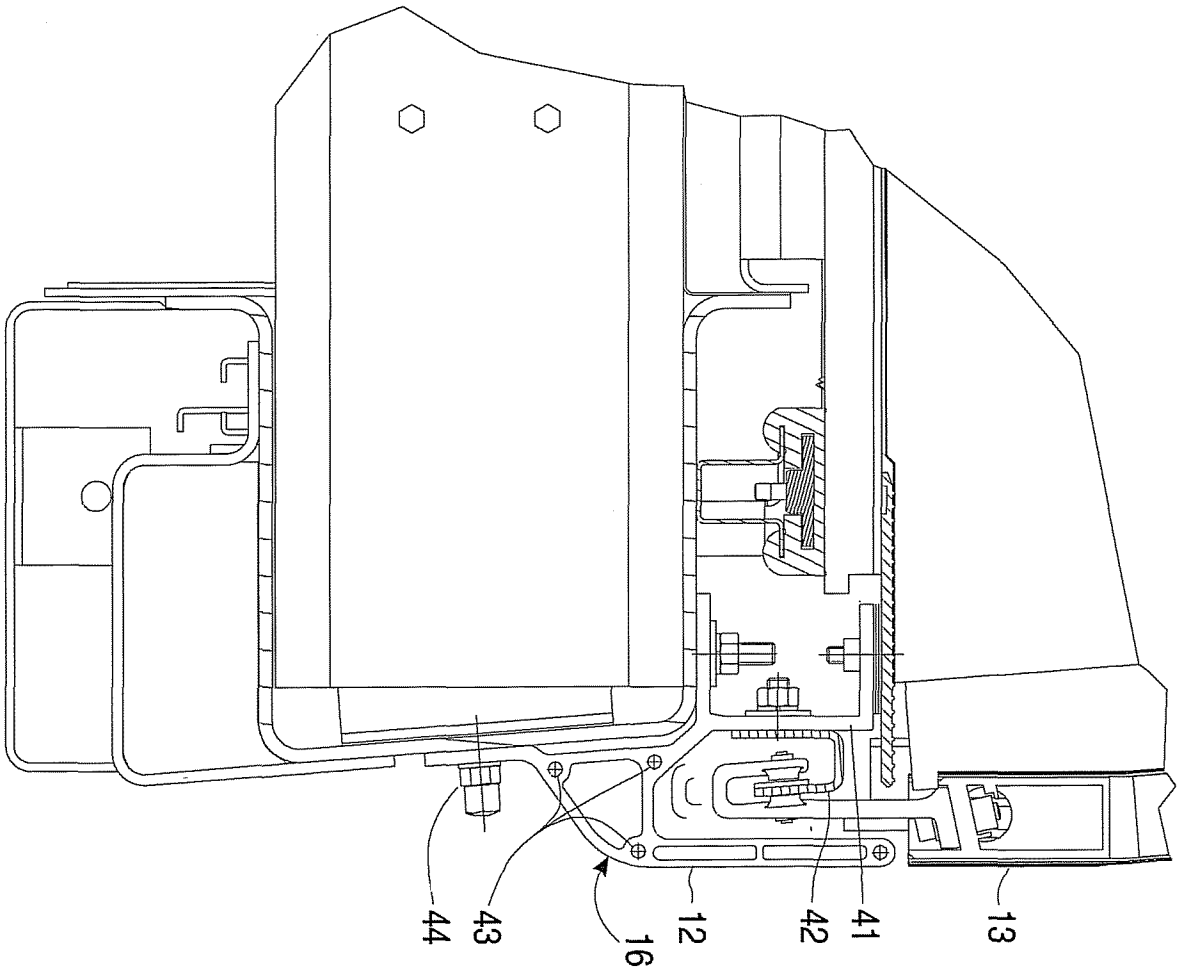

FIG. 3 shows in another detail (similar to that depicted in FIG. 2) the lower door rail with the lower cover 12. The lower door rail is realized with a guide carrier 16 which features a guide rail carrier (body) 41 which is rigidly connected to the rail car body 17. In accordance with the invention the cover 12 is part of the guide carrier; preferably it is embodied in one piece with the guide rail carrier 41. The cover 12 can additionally be attached with a further attachment means 44 to the lateral surface of the car body. The attachment means used here are for example threaded welded bolts, which are introduced through a drilled hole or slot and screwed on; naturally other suitable means are also possible.

A lower guide rail 42 is screwed on in the case shown as a separate component on the guide rail carrier 41.

Figure 4:
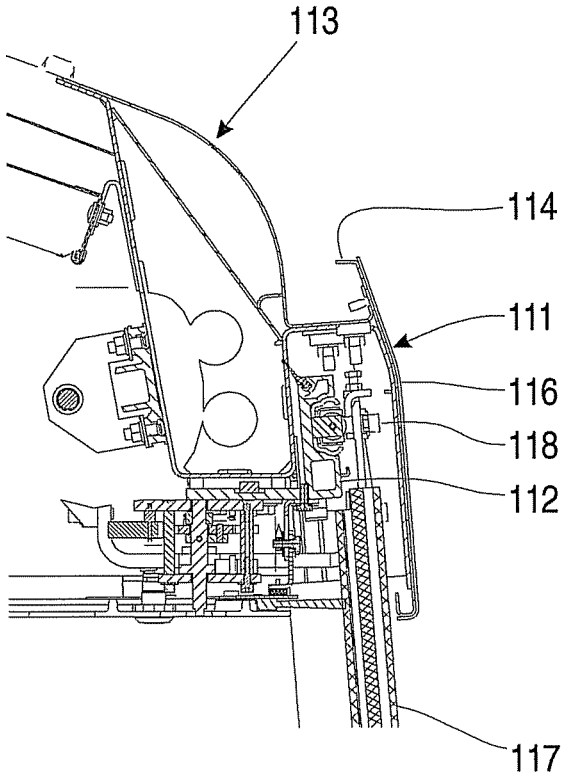
Fig. 4 Prior art
FIGS. 4 and 5 a known door attachment, with the views corresponding to those of FIGS. 2 and 3.

The component of the guide rail 32 with integrated upper cover 11 can be manufactured as a pressed aluminum profile, likewise the guide rail carrier 41 with integrated lower cover 12. At the end of the profile of the cover, as shown in FIG. 4, terminal holes 43 can be embodied to which closure caps can be attached.

The lower cover, in addition to its function as spray and visual protection, also serves to bridge the gap to the platform (entry aid). The one-piece realization with the upper door rail 15 provides a significantly increased stability as well as an improved action as water spray protection.

The invention claimed is:

1. A door attachment system of a rail car, comprising:

sliding doors;

an upper guide carrier attached to a car body of the rail car and running along a horizontal upper edge of a door opening of the sliding doors, the upper guide carrier being a one-piece body defining an upper guide rail carrier and an upper cover extending outwardly therefrom;

an upper guide rail attached to the upper guide rail carrier, the upper guide rail slidably supporting upper retaining elements provided at an upper edge of the sliding doors;

wherein the upper cover is oriented to cover the upper guide rail, the upper retaining elements, and the upper edge of the sliding doors;

seals attached to the upper cover which engage the car body and the sliding doors to protect the upper guide rail and the upper retaining elements against contamination from the outside;

a lower guide carrier attached to the car body of the rail car and running along a horizontal lower edge of the door opening of the sliding doors, the lower guide carrier being a one-piece body defining a lower guide rail carrier and a lower cover extending outwardly therefrom;

a lower guide rail attached to the lower guide rail carrier, the lower guide rail slidably supporting lower retaining elements provided at a bottom edge of the sliding doors; and wherein the lower cover is oriented to cover the lower guide rail and the lower retaining elements.

2. The door attachment system as claimed in claim 1, wherein the upper guide rail includes adjustment screws for adjusting a position of the sliding doors, the adjustment screws facing an interior of the sliding doors.

3. The door attachment system as claimed in claim 1, wherein the lower cover receives threaded welded bolts for attaching the lower cover to the car body.

4. The door attachment system as claimed in claim 1, wherein the upper guide carrier defines a lintel for the door opening.

5. The door attachment system as claimed in claim 1, wherein the lower guide carrier defines a threshold for the door opening.

6. The door attachment system as claimed in claim 1, wherein the rail car is a passenger rail car.

* * * * *